US006633012B2

(12) United States Patent
Hsu

(10) Patent No.: US 6,633,012 B2
(45) Date of Patent: Oct. 14, 2003

(54) KEY DEVICE WITH A SCISSORS-LIKE STRUCTURE

(75) Inventor: Chien-Shih Hsu, Taipei (TW)

(73) Assignee: Darfon Electronics Corp., Taoyuan (TW)

( * ) Notice: Subject to any disclaimer, the term of this patent is extended or adjusted under 35 U.S.C. 154(b) by 3 days.

(21) Appl. No.: 10/161,138

(22) Filed: May 30, 2002

(65) Prior Publication Data

US 2002/0185366 A1 Dec. 12, 2002

(30) Foreign Application Priority Data

Jun. 8, 2001 (TW) ..... 90113946 A

(51) Int. Cl.[7] ..... H01H 13/70
(52) U.S. Cl. ..... 200/344
(58) Field of Search ..... 200/5 A, 517, 200/344, 345; 400/490, 491, 491.2, 495, 495.1, 496

(56) References Cited

U.S. PATENT DOCUMENTS 6,087,604 A * 7/2000 Suga et al. ..... 200/344
6,160,233 A * 12/2000 Hu ..... 200/344
6,183,150 B1 * 2/2001 Kao ..... 400/495
6,504,121 B2 * 1/2003 Hasunuma ..... 200/344

* cited by examiner

*Primary Examiner*—Michael Friedhofer
(74) *Attorney, Agent, or Firm*—Snell & Wilmer L.L.P.

(57) ABSTRACT

A key device and an assembled method thereof improves the reliability of the key device and does not deteriorate ease of installation. The key device has a first arm and a second arm. The first arm has a shaft and the second arm has a slot that includes the first and second portions. The shaft and the slot are movably connected so that the first arm and the second arm form a scissors-like structure. When the shaft is located in the first portion of the slot, the shaft is allowed to rotate and to slide. When the shaft is located in the second portion of the slot, the shaft is allowed to rotate but not to slide.

2 Claims, 8 Drawing Sheets

KEY DEVICE WITH A SCISSORS-LIKE STRUCTURE

This application claims priority of Taiwan Patent Application Ser. No. 90113946 filed on Jun. 8, 2001.

FIELD OF INVENTION

The present invention generally relates to a key device for a keyboard and to an assembling method thereof.

BACKGROUND OF THE INVENTION

Scissors-like structures are widely used in low-profile key devices such as keyboards. Referring to FIG. 1*a*, a first frame 101 and a second frame 102 may be assembled to form a scissors-like structure. Two shafts 103 are respectively disposed on the outer surfaces of first frame 101, and axes of two shafts 103 may be aligned in a line as shown. Two slots 104 are respectively provided on inner surfaces of the frame 102, and axes of two slots 104 are aligned as shown. Two shafts 103 and two slots 104 are rotatably connected to each other to form a scissors-like structure. The scissors-like structure is connected to a keycap 107 and a base 108, as shown in FIG. 1*b*.

Referring to FIG. 1*b*, first frame 101 has two outer surfaces 105, 105' and second frame 102 has two inner surfaces 106, 106'. The distance between outer surfaces 105, 105' is typically about equal to the distance between inner surfaces 106, 106'. When shafts 103 are disposed into slots 104, first frame 101 is suitably compressed to shorten the span of the first frame 101 along axial direction A–A', or the second frame 102 has to be expended to lengthen the span of the second frame 102 along direction A–A'. In other words, one of two frames 101 or 102 appropriately deforms its shape during assembly. It is typically desired to minimize deformation of the frames during assembly to prevent breakage and to strengthen the key structure. One solution is to shorten the length of the shafts 103, although this results in a less-stable key structure.

The reliability of scissors-like structure 100 typically depends on an effective length of the shaft 103. The effective length of the shaft 103 is defined as the length carrying radial force after the shafts 103 and the slots 104 are assembled together. If the effective length of the shaft 103 is shortened, the reliability of scissors-like structure decreases. For example, when a user detaches the keycap 107 from the structure, a shorter shaft 103 may escape from slot 104 and frames 101 and 102 may become separated.

Ease of assembly and reliability of a key device do not coexist in the prior art. A demand for a key device with these characteristics therefore exists.

SUMMARY OF THE INVENTION

One aspect of the present invention is to provide a key device which gives consideration to assembly convenience and reliability.

Another aspect of the present invention is to provide a method for assembling the key device.

An exemplary key device of the present invention includes first and second arms.

The first arm has a shaft and the second arm has a slot with an open first end and a closed second end. The first and second portions are connected to each other, and the second portion define an axial direction. The first and second arms are rotatably assembled to form a scissors-like structure. When the shaft is in the first portion of the slot, the shaft can slide and rotate. When the shaft is the second portion of the slot, the shaft can rotate but not slide.

An assembling method for the key device is also provided in the present invention. The key device includes a first and second arms. The first arm has a shaft and the second arm has a slot with an open first end and a closed second end. The first and second portions are connected to each other, and the second portion define an axial direction. The method includes the steps of disposing the shaft into the first portion via the open first end. The shaft slides along the first portion. Finally, when the shaft and second portion are substantially in a line, the shaft is pushed into the second portion along the axial direction.

DETAILED DESCRIPTION

Various embodiments of the present invention provide a key device which gives consideration to assembly convenience and reliability.

Figure 1A:
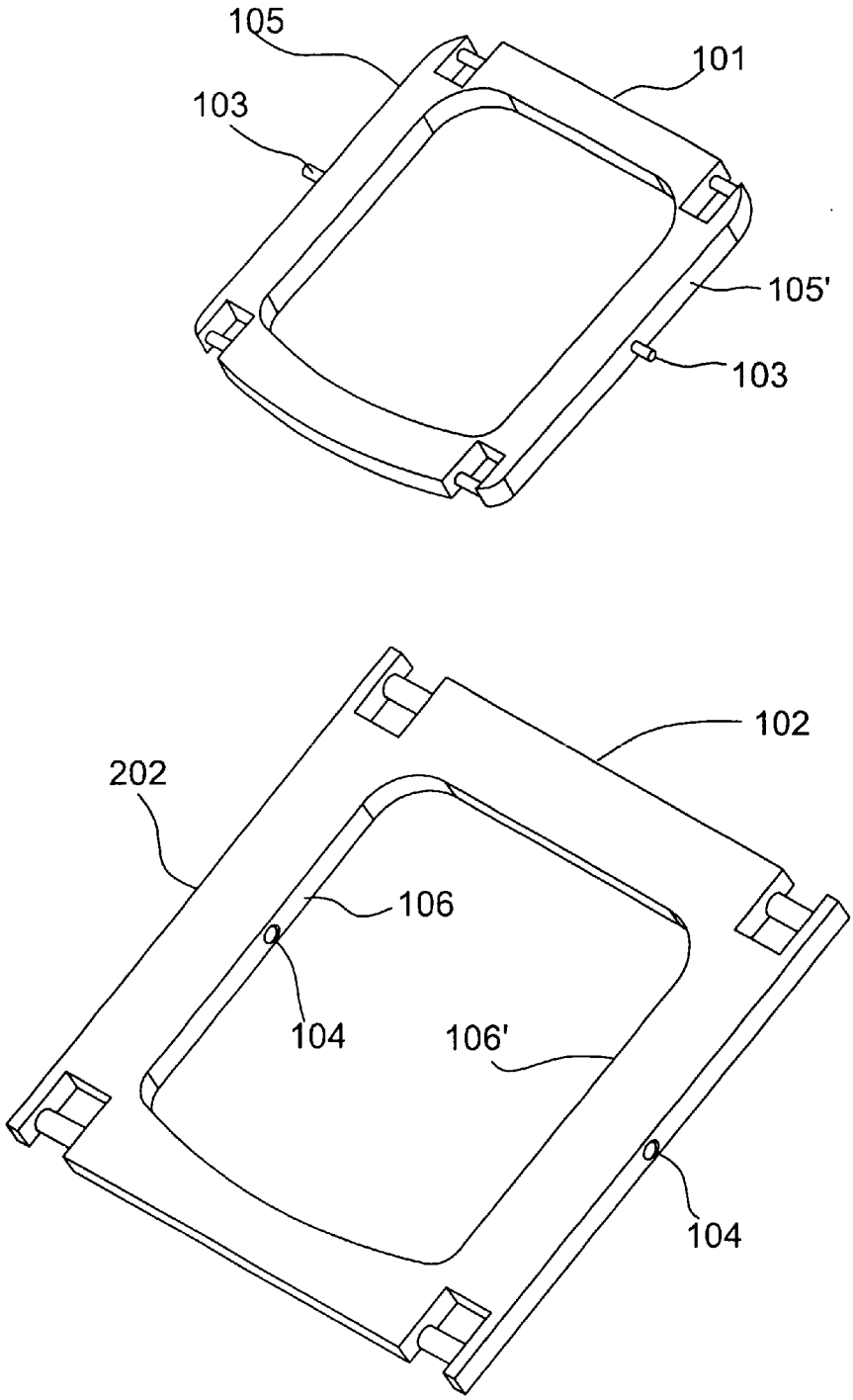
Fig. 1a(Prior Art)
FIGS. 1*a* and 1*b* are schematic diagrams showing a conventional key device with a scissors-like structure.
Figure 1B:
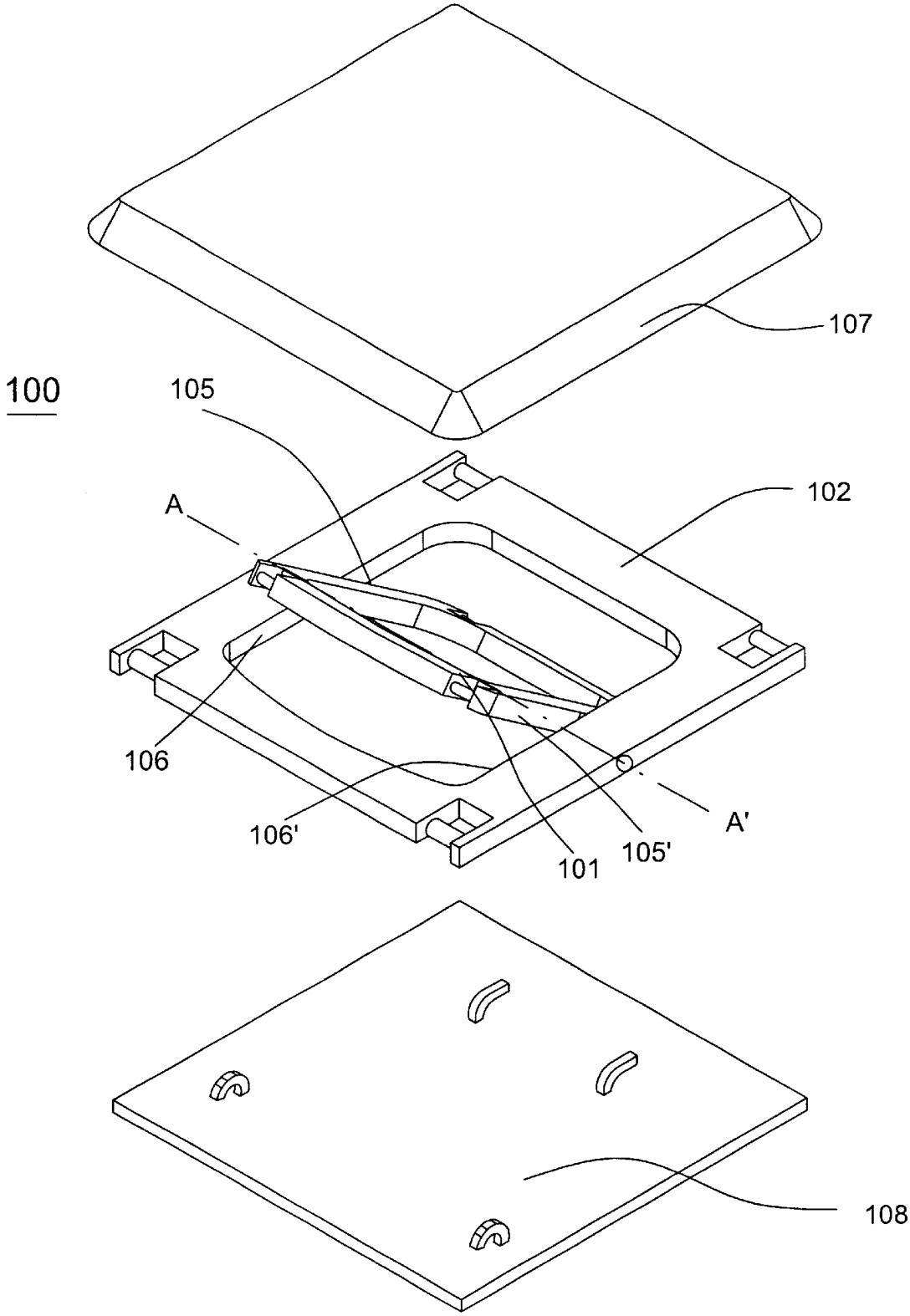
Fig. 1b(Prior Art)
Figure 2A:
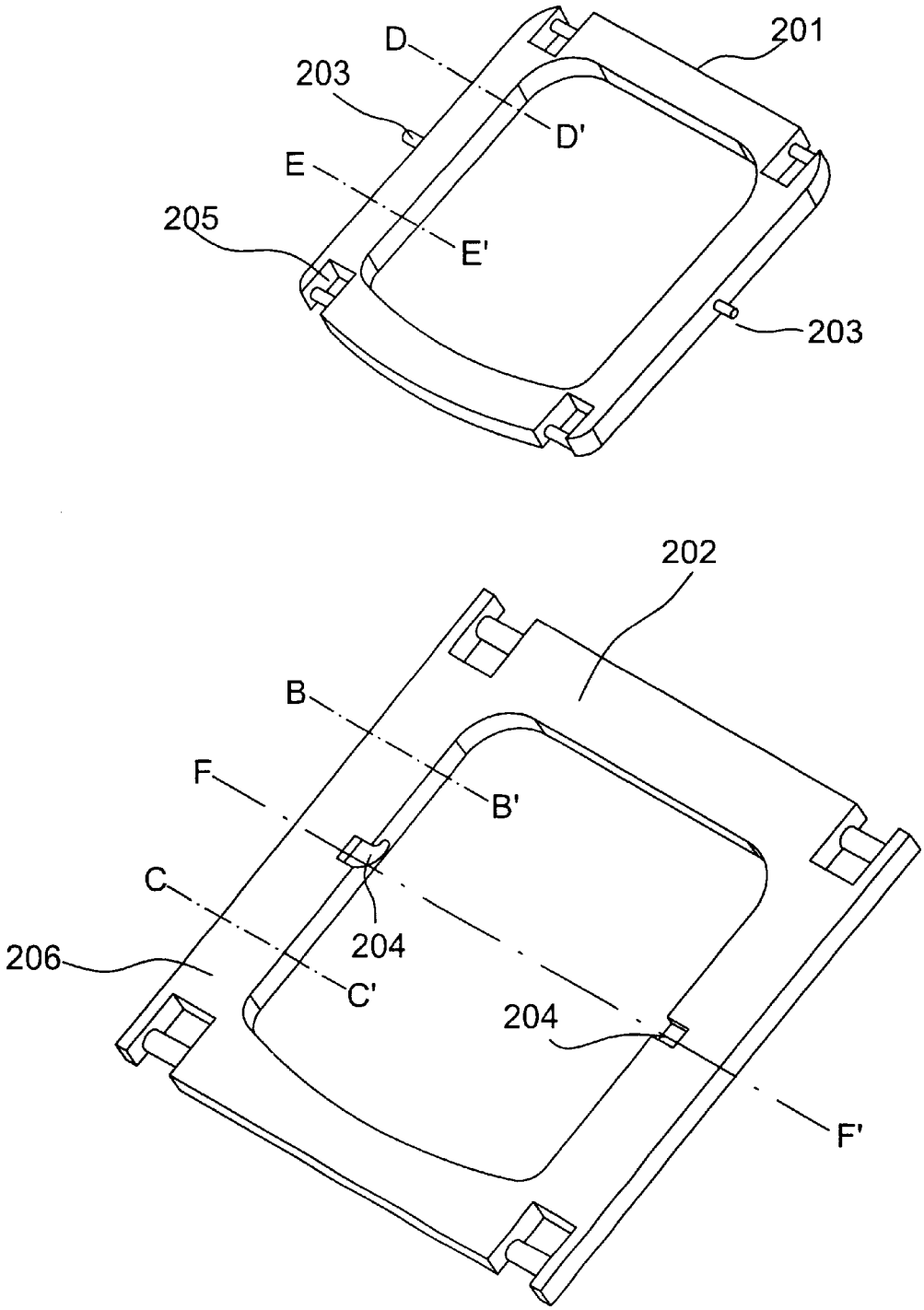
FIGS. 2*a*, 2*b*, 2*c* and 3 are schematic diagrams showing exemplary first frames 201 and second frames 202.

FIG. 2*a* is a schematic diagram of an embodiment showing first frame 201 and second frame 202 of a key device in one embodiment of the present invention. First frame 201 is a quadrilateral including two arms and two linking members. Two shafts 203 are disposed on the two arms respectively. Second frame 202 is also a quadrilateral including two arms and two linking members. Two slots 204 are provided on the two arms respectively. Because two arms of each frame are symmetric, the description hereafter is focused on one arm of the first frame 201, i.e. first arm 205, and one arm of the second frame 202, i.e. second arm 206. Similar concepts may be applied to other components.

In the embodiment shown in FIG. 2*a*, both first arm 205 and second arm 206 have rectangular cross-sections. However, the scope of present invention is not restricted to arms with a rectangular cross-section, but also includes arms with quadrilateral, angular or any other shaped cross-sections.

Figure 2B:
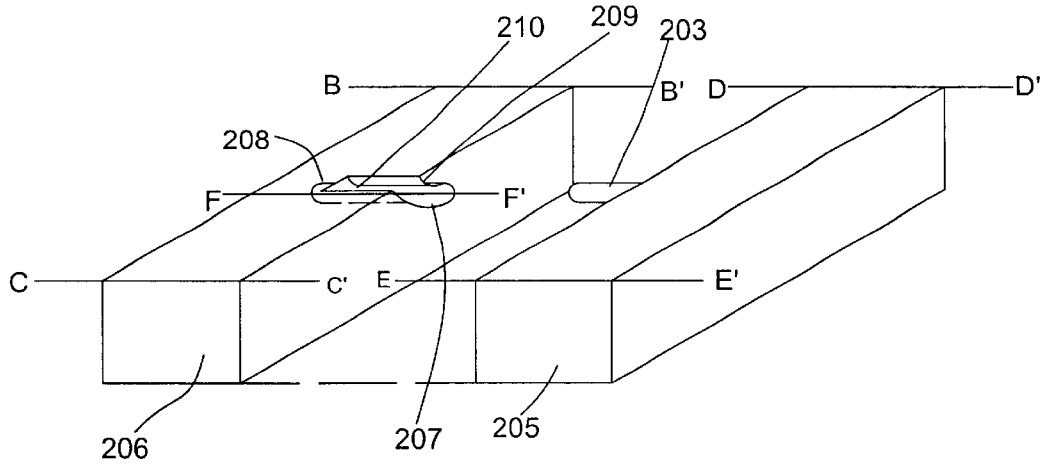

FIG. 2*b* is an enlarged diagram of a portion of arms 205 and 206. The part of first arm 205 shown is the section between cross-section line D–D' and E–E', and the part of second arm 206 shown is the section between cross-section line B–B' and C–C', as shown in FIG. 2*a*. Slot 204 includes a first portion 207 and a second portion 208. The second portion 208 defines an axial direction F–F'. The first portion 207 has an appropriately curved shape to allow shaft 203 to slide and rotate along first portion 207. One end of first portion 207 includes an opening 210 formed on surface 209, and the other end is appropriately adjacent to second portion 208, as shown. When shaft 203 is placed within second portion 208, shaft 208 is allowed to rotate but not slide. A scissors-like structure is therefore formed while shaft 203 is disposed in slot 204.

In the embodiment and drawings described above, shaft 203 and second portion 208 are cylindrical in shape.

However, the scope of the present invention is not restricted to shapes. Any suitable structure that allows shaft 203 to rotate in second portion 208 is considered to be within the scope of the present invention.

Figure 2C:
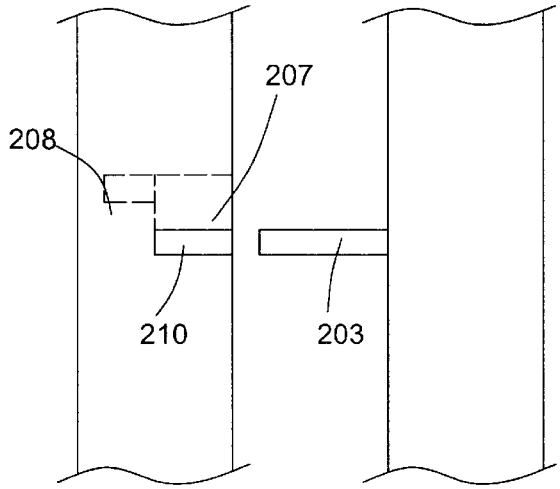

In an exemplary embodiment, the length of opening 210 is shorter than the length of shaft 203, as shown in FIG. 2*c*. The length of shaft 203 is shown to be equal to the sum of the length of opening 210 and that of second portion 208, as appropriate. Second portion 208 has an opening portion perpendicular to the axial direction F–F'. If shaft 203 is pulled out of slot 204, shaft 203 first moves along the axial direction F–F'. When shaft 203 is disposed in second portion 208, shaft 203 is fixably held and prohibited from exiting slot 204. Thus, the reliability of key device is increased.

Figure 3:
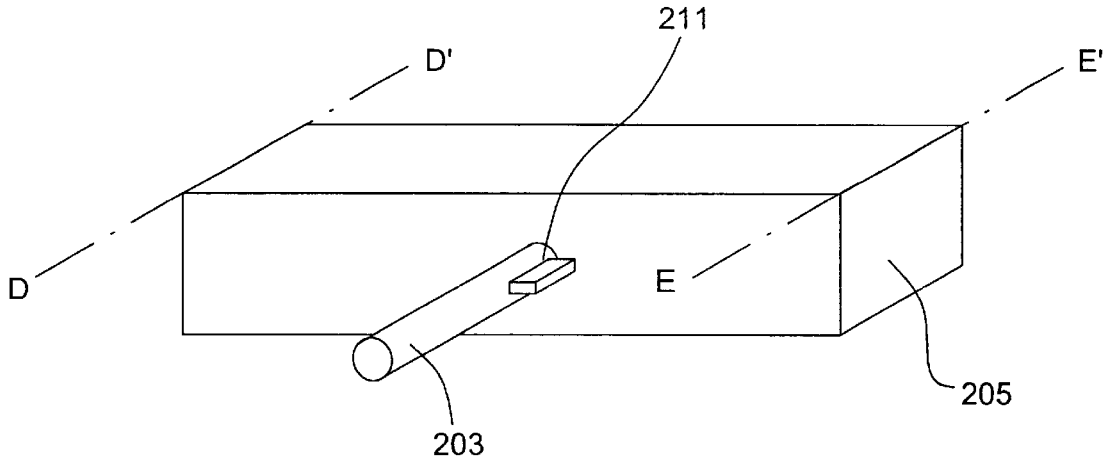

In another exemplary embodiment, shaft 203 has a protrusion 211 near first arm 205, as shown in FIG. 3. The length of protrusion 211 along the axial direction F–F' is substantially shorter than that of first portion 207 and opening 210 along the axial direction F–F'. When shaft 203 is in slot 204 and first frame 201 is parallel to the second frame 202, protrusion 211 suitably bears no force. After first arm 205 is rotated an angle relative to second arm 206, protrusion 211 engages with inner surface of slot 204 and stops shaft 203 from further rotating.

Protrusion 211 may be used to restrict the rotation range of first arm 205 relative to second arm 206. The size of the range varies depending on the design of the key device.

Figure 4:
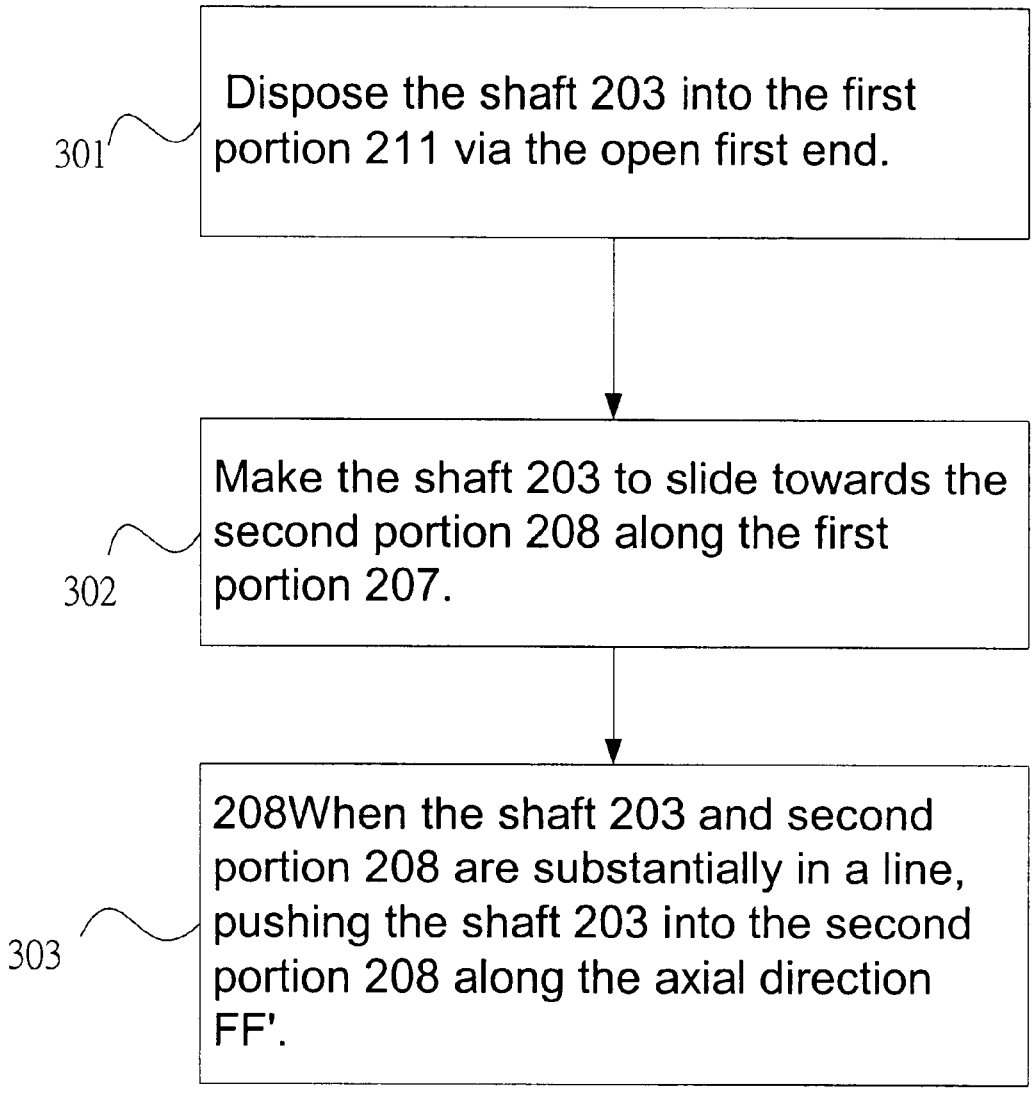
FIG. 4 is a flow chart describing steps of an exemplary method for assembling a key device.
Figure 5A:
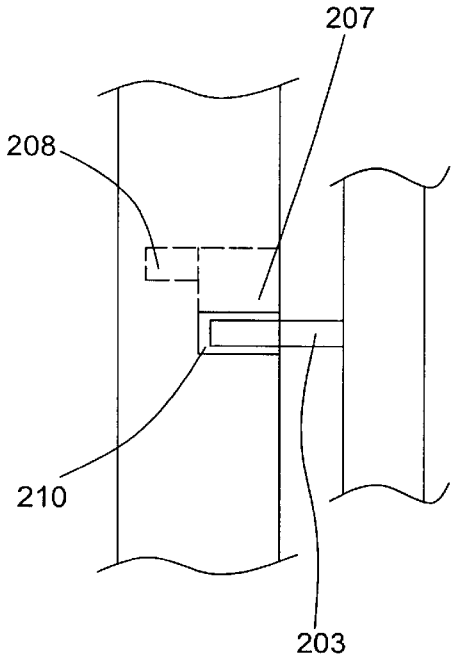
FIGS. 5*a–d* are schematic diagrams showing different stages while the frames 201 and 202 are being assembled.
Figure 5B:
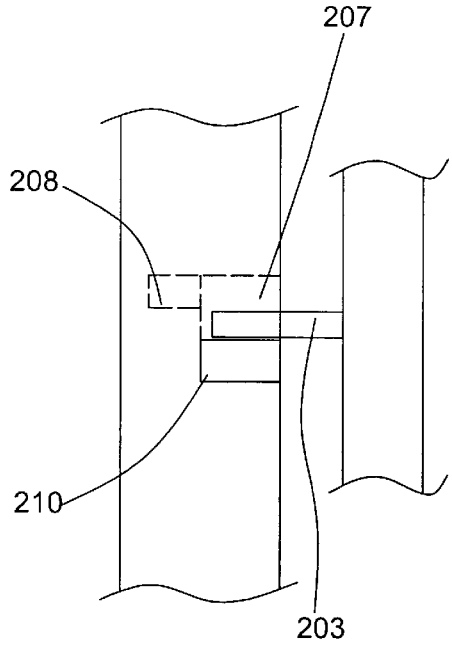
Figure 5C:
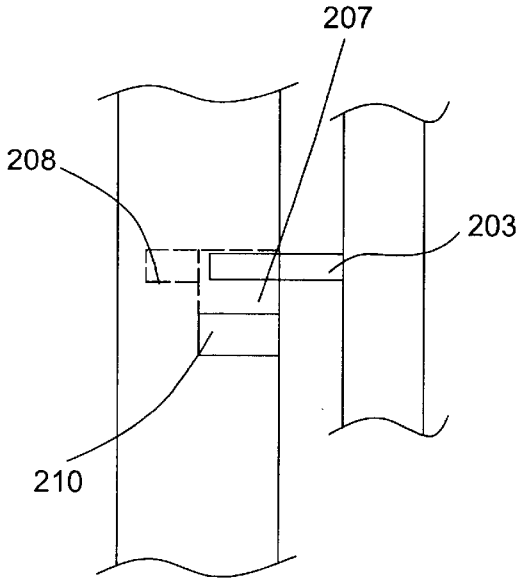
Figure 5D:
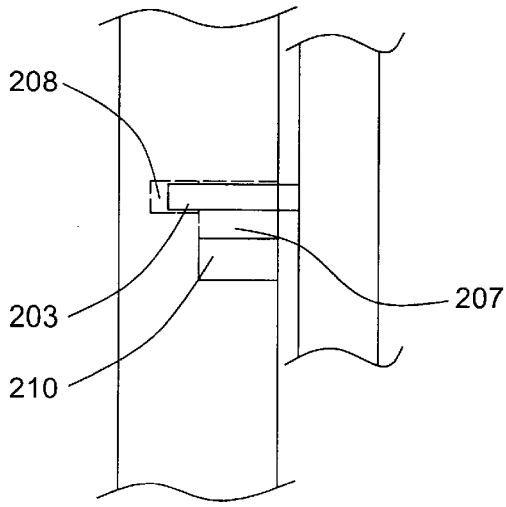

Referring now to the flow chart in the FIG. 4 and the schematic diagrams in FIG. 5*a* to FIG. 5*d*, the present invention also provides a method for assembling a key device. First, in step 301, shaft 203 is disposed in first portion 207 via opening 210, as shown in FIG. 5*a*. Next, in step 302, shaft 203 slides towards the second portion 208 along first portion 207, as shown FIG. 5*b*. Then, in step 303, when shaft 203 and second portion 208 are substantially in a line, as shown in FIG. 5*c*, shaft 203 is pushed in the second portion 208, as shown in FIG. 5*d*. Finally, the assembly of key device is completed.

Figure 6:
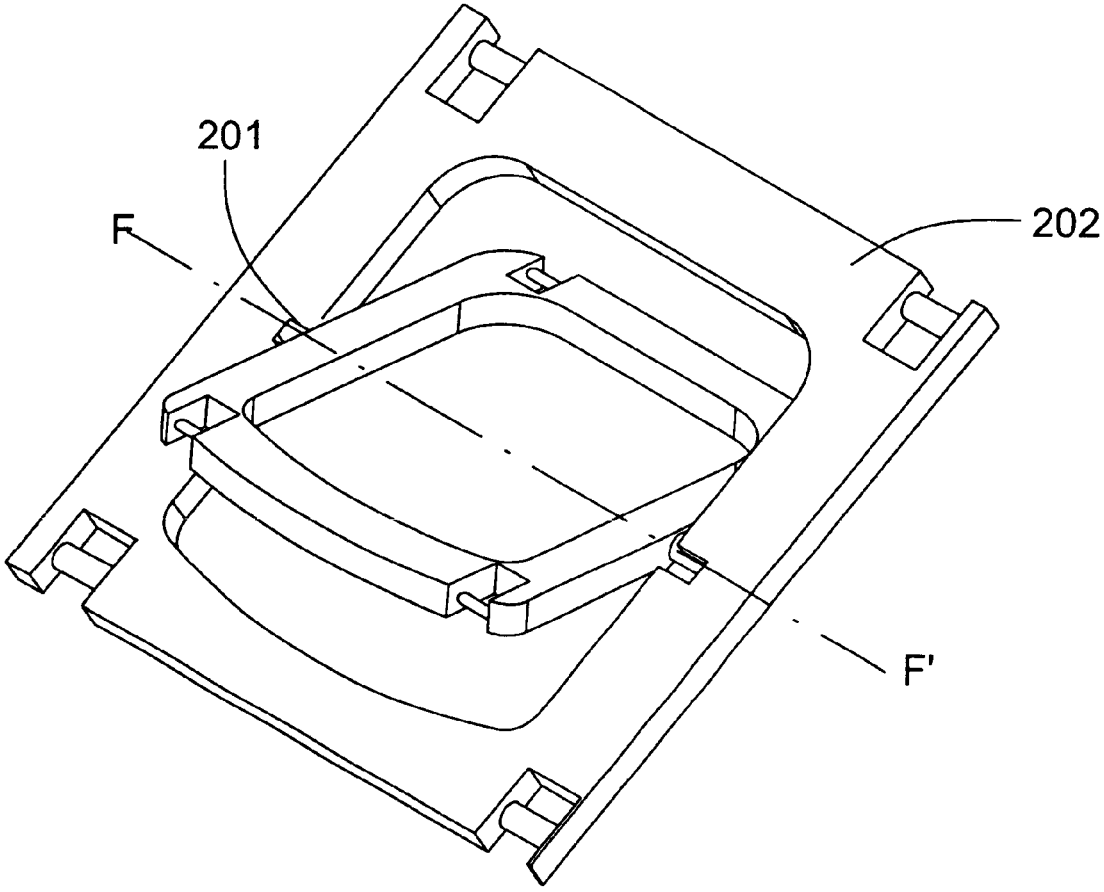
FIG. 6 is a schematic diagram showing an exemplary first frame 201 and second frame 202 assembled together.

Referring again to FIG. 2*a*, first arm 205 is disposed on first frame 201, and second arm 206 is disposed on second frame 202. The method for assembling first frame 201 and second frame 202 is described as follows. First, first frame 201 is compressed or otherwise manipulated to deform the shape as appropriate. The distance between the two arms of first frame 201 along axial direction F–F' is thereby shortened until shaft 203 can be disposed in first portion 203 via opening 210. Next, shaft 203 slides towards second portion 208 along first portion 207. Then, when shaft 203 and second portion 208 are substantially in a line, first frame 201 returns to its original shape and shaft 203 is pushed into the second portion 208. Finally, first frame 201 and second frame 202 are assembled together, as shown in FIG. 6. First frame 201 and second frame 202 can rotate relative to each other around axial direction F–F'.

It should be noted that the shape of the first portion of the slot is not restricted to a curve shape as shown in the drawings. Any slot that can accommodate the shaft and that allows the shaft to slide easily therein is within the scope of the present invention. For example, a slot with a rectangular portion and a slot with a columnar portion are alternate embodiments.

The present invention can be practiced in other ways without departing from the spirit and scope of the invention. The scope of the present invention is not restricted by the description. It is therefore contemplated that the appended claims will cover any modifications or other embodiments that may fall within the scope of the appended claims and any equivalents thereof.

What is claimed is:

1. A key device comprising:

a first arm having a shaft; and a second arm having a slot with an open first end and a closed second end, said slot comprising a first portion and a second portion, said first portion communicating said second portion, said second portion defining an axial direction, wherein a length of said first portion along said axial direction is substantially shorter than said shaft, and wherein said first arm and said second arm form a scissors-like structure with said shaft disposed within said second portion;

wherein, while said first arm is being assembled to said second arm, said shaft is first disposed into said first portion via said open first end, and then said shaft slides along said first portion, and further said shaft is pushed into said second portion along said axial direction.

2. The key device according to claim 1, wherein said first portion defines an inner surface, said shaft comprises a circumferential surface, said shaft defines a radial direction, and a protrusion extends from said circumferential surface along said radial direction, and wherein said inner surface of said first portion limits rotation angle of said protrusion within said slot, when said shaft is disposed in said second portion.

* * * * *